US005912109A

United States Patent [19]

Anderson et al.

[11] Patent Number: 5,912,109

[45] **Date of Patent: *Jun. 15, 1999**

[54] IMAGING ELEMENT COMPRISING AN ELECTRICALLY-CONDUCTIVE LAYER CONTAINING CONDUCTIVE FINE PARTICLES AND WATER-INSOLUBLE POLYMER PARTICLES OF SPECIFIED SHEAR MODULUS

[75] Inventors: Charles Chester Anderson; Yongcai Wang, both of Penfield; Mario Dennis DeLaura, Hamlin, all of N.Y.

[73] Assignee: Eastman Kodak Company, Rochester, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/599,908

[22] Filed: Feb. 12, 1996

[51] Int. Cl.[6] ..... G03C 1/85

[52] U.S. Cl. ..... 430/530; 430/527; 430/529; 430/536; 430/631; 430/950; 430/63; 430/215; 430/262; 430/271.1

[58] Field of Search ..... 430/63, 215, 262, 430/271.1, 527, 529, 530, 536, 631, 950

[56] References Cited

U.S. PATENT DOCUMENTS

| | | | |
|---|---|---|---|
| 3,773,517 | 11/1973 | Dodwell | 430/628 |
| 4,294,739 | 10/1981 | Upson et al. | 430/527 |
| 4,510,238 | 4/1985 | Kingston et al. | 430/631 |
| 5,061,595 | 10/1991 | Gingello et al | 430/961 |
| 5,175,073 | 12/1992 | Gingello et al. | 430/950 |
| 5,279,933 | 1/1994 | Gingello et al. | 430/509 |
| 5,340,676 | 8/1994 | Anderson et al. | 430/63 |
| 5,372,921 | 12/1994 | Gingello et al. | 430/509 |
| 5,447,832 | 9/1995 | Wang et al. | 430/523 |
| 5,459,021 | 10/1995 | Ito et al. | 430/527 |
| 5,466,567 | 11/1995 | Anderson et al. | 430/530 |
| 5,529,893 | 6/1996 | Valsecchi et al. | 430/529 |

FOREIGN PATENT DOCUMENTS 0 343 642 A2 11/1989 European Pat. Off. .

*Primary Examiner*—Geraldine Letscher
*Attorney, Agent, or Firm*—Carl F. Ruoff; Alfred P. Lorenzo

[57] ABSTRACT

Imaging elements, such as photographic, electrostatographic and thermal imaging elements, comprised of a support, an image-forming layer and an electrically-conductive layer consisting essentially of electrically-conductive fine particles, such as antimony-doped tin oxide particles and, as a binder, water-insoluble polymer particles. The use of water-insoluble polymer particles of an appropriate shear modulus as a binder in the electrically-conductive layer provides a layer with a high degree of conductivity at low concentrations of electrically-conductive fine particles.

20 Claims, No Drawings

IMAGING ELEMENT COMPRISING AN ELECTRICALLY-CONDUCTIVE LAYER CONTAINING CONDUCTIVE FINE PARTICLES AND WATER-INSOLUBLE POLYMER PARTICLES OF SPECIFIED SHEAR MODULUS

CROSS-REFERENCE TO RELATED APPLICATIONS

Copending commonly-assigned U.S. Provisional Patent Application Serial No. 60/000236, filed Jun. 15, 1995, "Imaging Element Comprising An Electrically-Conductive Layer With Enhanced Abrasion Resistance" by Charles C. Anderson, Yongcai Wang, James L. Bello and Mario D. DeLaura describes imaging elements containing an electrically-conductive layer comprising electrically-conductive fine particles and gelatin-coated water-insoluble polymer particles.

Copending commonly-assigned U.S. patent application Ser. No. 08/598,950, filed Feb. 12, 1996, "Imaging Element Comprising An Electrically-Conductive Layer Containing Conductive Fine Particles And Water-Insoluble Polymer Particles Containing Sulfonic Acid Groups" by Charles C. Anderson, Yongcai Wang and Mario D. DeLaura describes imaging elements containing an electrically-conductive layer consisting essentially of electrically-conductive fine particles and, as the binder, water-insoluble polymer particles containing sulfonic acid groups that provide enhanced performance.

FIELD OF THE INVENTION

This invention relates in general to imaging elements, such as photographic, electrostatographic and thermal imaging elements, and in particular to imaging elements comprising a support, an image-forming layer and an electrically-conductive layer. More specifically, this invention relates to such imaging elements having an electrically-conductive layer containing electrically-conductive fine particles and, as the binder, water-insoluble polymer particles of specified shear modulus that provide enhanced performance.

BACKGROUND OF THE INVENTION

A variety of problems associated with the formation and discharge of electrostatic charge during the manufacture and use of photographic films are well recognized in the photographic industry. These electrostatic charges are generated by the highly insulating polymeric film bases, such as polyester and cellulose acetate, during winding and unwinding operations associated with the photographic film manufacturing process and during the automated transport of photographic films in film cassette loaders, cameras, and film processing equipment during use of the photographic film product.

It is well known that electrostatic charges can be effectively controlled or eliminated by incorporating one or more electrically-conductive antistatic layers in the photographic film. A wide variety of conductive materials can be incorporated into antistatic layers to provide a wide range of conductivity and antistatic performance. Typically, the antistatic layers for photographic applications employ materials which exhibit ionic conductivity where the charge is transferred by the bulk diffusion of charged species through an electrolyte. Antistatic layers comprising inorganic salts, ionic conductive polymers, and colloidal metal oxide sols stabilized by salts have been described. U.S. Pat. No. 4,542,095 discloses antistatic compositions for use in photographic elements wherein aqueous latex compositions are used as binder materials in conjunction with polymerized alkylene oxide monomers and alkali metal salts as the antistatic agents. U.S. Pat. No. 4,916,011 describes antistatic layers comprising ionically conductive styrene sulfonate interpolymers, a latex binder, and a crosslinking agent. U.S. Pat. No. 5,045,394 describes antistatic backing layers containing Al-modified colloidal silica, latex binder polymer, and organic or inorganic salts which provide good writing or printing surfaces. The conductivities of these ionic conductive antistatic layers are very dependent on humidity and film processing. At low humidities and after conventional film processing the antistatic performance is substantially reduced or ineffective.

Antistatic layers employing electronic conductors have also been described. The conductivity of these materials depends on primarily electronic mobilities rather than ionic mobilities and the conductivity is independent of humidity. Antistatic layers which contain conjugated polymers, semiconductive metal halide salts, conductive carbon or semiconductive metal oxide particles have been described. It is characteristic of these electronically conductive materials to be highly colored or have high refractive index. Thus, providing highly transparent, coloress antistatic layers containing these materials poses a considerable challenge.

U.S. Pat. No. 3,245,833 describes conductive coatings containing semiconductive silver or copper iodide dispersed as 0.1 $\mu$m or less particles in an insulating film-forming binder exhibiting surface resistivities of $10^2$ to $10^{11}$ $\Omega$ per square. However, these coatings must be overcoated with a water-impermeable barrier layer to prevent the loss of conductivity after film processing since these semiconductive salts are solubilized by conventional film processing solutions.

Conductive layers comprising inherently conductive polymers such as polyacetylene, polyaniline, polythiophene, and polypyrrole are described in U.S. Pat. No. 4,237,194, JP A2282245, and JP A2282248, but, these layers are highly colored.

Conductive fine particles of crystalline metal oxides dispersed with a polymeric binder have been used to prepare humidity insensitive, conductive layers for various imaging applications. Many different metal oxides are alleged to be useful as antistatic agents in photographic elements or as conductive agents in electrographic elements in such patents as U.S. Pat. Nos. 4,275,103, 4,394,441, 4,416,963, 4,418,141, 4,431,764, 4,495,276, 4,571,361, 4,999,276, 5,368,995 and 5,457,013. Preferred metal oxides are antimony doped tin oxide, aluminum doped zinc oxide, niobium doped titanium oxide, and metal antimonates. These patents do not teach any specific requirements for the binder polymer and, as a result, there is a need for a high volume % of the conductive fine particles in the conductive coatings in order to achieve effective antistatic performance. This results in reduced transparency due to scattering losses and in brittle films subject to cracking and poor adherence to the support material.

JP A4055492 describes antistatic layers comprising conductive non-oxide particles including TiN, $NbB_2$, TiC, and MoB dispersed in a binder such as a water soluble polymer or solvent soluble resin.

U.S. Pat. No. 5,066,422 describes vinyl surface covering materials comprising a fused sheet of a dry blend, wherein the dry blend contains a polyvinyl chloride porous resin, a plasticizer, and conductive particles. Reportedly, the conductive particles reside in the pores and surface of the polyvinyl chloride resin which thereby provides surface resistivities of the fused sheet of $10^9$ Ω per square at low weight % of the conductive particles.

Fibrous conductive powders comprising antimony doped tin oxide coated onto nonconductive potassium titanate whiskers have been used to prepare conductive layers for photographic and electrographic applications. Such materials have been disclosed in U.S. Pat. No. 4,845,369, U.S. Pat. No. 5,116,666, JP A63098656, and JP A63060452. Layers containing these conductive whiskers dispersed in a binder reportedly provide improved conductivity at lower volume % than the aforementioned conductive fine particles as a result of their higher aspect (length to diameter) ratio. However, the benefits obtained as a result of the reduced volume % requirements are offset by the fact that these materials are large in size (10 to 20 μm long and 0.2–0.5 μm diameter). The large size results in increased light scattering and hazy coatings.

Transparent, binderless, electrically semiconductive metal oxide thin films formed by oxidation of thin metal films which have been vapor deposited onto film base are described in U.S. Pat. No. 4,078,935. The resistivity of such conductive thin films has been reported to be $10^5$ Ω per square. However, these metal oxide thin films are unsuitable for photographic film applications since the overall process used to prepare them is complex and expensive and adhesion of these thin films to the film base and overlying layers is poor.

U.S. Pat. No. 4,203,769 describes an antistatic layer incorporating "amorphous" vanadium pentoxide. This vanadium pentoxide antistat is highly entangled, high aspect ratio ribbons 50–100 Å wide, about 10 Å thick, and 0.1–1 μm long. As a result of this ribbon structure surface, resistivities of $10^{6-1011}$ Ω per square can be obtained for coatings containing very low volume fractions of vanadium pentoxide. This results in very low optical absorption and scattering losses. Thus the coatings are highly transparent and colorless. However, vanadium pentoxide is soluble at the high pH typical of film developer solutions and must be overcoated with a nonpermeable barrier layer to maintain antistatic performance after film processing.

It can be seen that a variety of methods have been reported in an attempt to obtain non-brittle, adherent, highly transparent, colorless conductive coatings with humidity independent, film process surviving antistatic performance. The aforementioned prior art references relate to some aspects of the present invention, but, they are deficient with regard to simultaneously satisfying all of the above mentioned requirements.

U.S. Pat. No. 5,340,676 describes conductive layers comprising electrically-conductive fine particles, hydrophilic colloid, and water-insoluble polymer particles. Representative polymer particles described include polymers and interpolymers of styrene, styrene derivatives, alkyl acrylates or alkyl methacrylates and their derivatives, olefins, vinylidene chloride, acrylonitrile, acrylamide and methacrylamide derivatives, vinyl esters, vinyl ethers, or condensation polymers such as polyurethanes and polyesters. The use of a mixed binder comprising the polymer particles mentioned above in combination with a hydrophilic colloid such as gelatin provides a conductive coating that requires lower volume % conductive fine particles compared with a layer obtained from a coating composition comprising the conductive fine particles and water soluble hydrophilic colloid alone. Copending commonly-assigned U.S. Provisional Patent Application Serial No. 60/000236, filed Jun. 15, 1995, describes a further improvement to the '676 patent in that the water-insoluble polymer particles are gelatin-grafted polymer particles. The use of gelatin-grafted polymer particles improves the stability of the coating formulation. U.S. Pat. No. 5,466,567 describes conductive layers comprising electrically-conductive fine particles, hydrophilic colloid, and water-insoluble, precrosslinked gelatin particles. Electrically-conductive layers prepared from coating compositions described in the '676 patent, application Ser. No. 60/000236 and the '567 patent are especially useful when the conductive layer is to be overcoated with a layer containing a hydrophilic colloid.

It is toward the objective of providing a new and improved electrically-conductive layer that is capable of utilizing low volume percentages of the electrically-conductive fine particles that the present invention is directed. Use of such low volume percentages provides improved layer transparency since most of the known electrically-conductive fine particles have a high refractive index or are highly colored. In addition, minimizing the amount of electrically-conductive fine particles incorporated into a dried coating, especially for conductive metal oxide particles, can provide improved physical properties (e.g., freedom from brittleness), reduced cost for the coated layer, and reduced finishing tool wear.

SUMMARY OF THE INVENTION

In accordance with this invention, an imaging element for use in an image-forming process comprises a support, an image-forming layer, and an electrically-conductive layer. The electrically-conductive layer is formed by coating a composition consisting essentially of electrically-conductive fine particles and, as a binder, water-insoluble polymer particles and drying the coating at an elevated temperature. The water-insoluble polymer particles are characterized in that at least a surface layer thereof has a shear modulus at the drying temperature that is greater than $5\times10^5$ dyne/cm$^2$ and less than $5\times10^8$ dyne/cm$^2$.

The combination of electrically-conductive fine particles and water-insoluble polymer particles having the aforesaid shear modulus provides conductive coatings which can employ low volume percentages of conductive particles and still provide the desired high degree of conductivity.

DETAILED DESCRIPTION OF THE INVENTION

The imaging elements of this invention can be of many different types depending on the particular use for which they are intended. Such elements include, for example, photographic, electrostatographic, photothermographic, migration, electrothermographic, dielectric recording and thermal-dye-transfer imaging elements.

Details with respect to the composition and function of a wide variety of different imaging elements are provided in U.S. Pat. No. 5,340,676 and references described therein. The present invention can be effectively employed in conjunction with any of the imaging elements described in the '676 patent.

Photographic elements represent an important class of imaging elements within the scope of the present invention. In such elements, the electrically-conductive layer may be applied as a subbing layer, an intermediate layer, or as the outermost layer on the sensitized emulsion side of the support, on the side of the support opposite the emulsion, or on both sides of the support. The support may comprise any commonly used photographic support material such as polyester, cellulose acetate, or resin-coated paper. The electrically-conductive layer is applied from a coating formulation consisting essentially of electrically-conductive fine particles and a water-insoluble polymer particle binder. The conductive fine particle can be, for example, a doped-metal oxide, a metal oxide containing oxygen deficiencies, a metal antimonate, or a conductive nitride, carbide, or boride. Representative examples of these conductive fine particles include conductive $TiO_2$, $SnO_2$, $Al_2O_3$, $ZrO_3$, $In_2O_3$, MgO, $ZnSb_2O_6$, $InSbO_4$, $TiB_2$, $ZrB_2$, $NbB_2$, $TaB_2$, $CrB_2$, MoB, WB, $LaB_6$, ZrN, TiN, TiC, and WC. The conductive fine particle may also be an electrically conductive polymer particle comprising inherently conductive polymers such as polyacetylenes, polyanilines, polythiophenes and polypyrroles. The conductive fine particle preferably has an average particle size less than about 0.3 $\mu$m and a powder resistivity of $10^5$ $\Omega\cdot$cm or less.

The water-insoluble polymer particle binder preferably has an average diameter of about 10 nm to 1000 nm. More preferably, the particles have an average particle diameter of 20 to 500 nm. The polymer particle can be a homopolymer or interpolymer prepared by emulsion polymerization of ethylenically unsaturated monomers or by post emulsification of preformed polymers. In the latter case, the preformed polymers may be first dissolved in an organic solvent and then the polymer solution emulsified in an aqueous media in the presence of an appropriate emulsifier. In both cases, chain transfer agents including mercaptans, polymercaptans, and halogen compounds can be used in the polymerization mixture to moderate the polymer molecular weight. The weight average molecular weight of the polymers may vary from 5,000 to 30,000,000 and preferably from 10,000 to 10,000,000. Representative polymer particles include those comprising polymers and interpolymers of styrene, styrene derivatives, alkyl acrylates or alkyl methacrylates and their derivatives, itaconic acid and its derivatives such as mono- and di-esters, olefins, vinylidene chloride, acrylonitrile, acrylamide and methacrylamide derivatives, vinyl esters, and vinyl ethers. In addition, crosslinking monomers such as 1,4-butyleneglycol methacrylate, trimethylolpropane triacrylate, allyl methacrylate, diallyl phthalate, divinyl benzene, and the like may be used in order to give a crosslinked polymer particle. The polymer particles may contain reactive functional groups capable of forming covalent bonds by intermolecular crosslinking or by reaction with a crosslinking agent (i.e., a hardener) during the drying process or during a post-dry backing process. Suitable reactive functional groups include: hydroxyl, carboxyl, carbodiimide, epoxide, aziridine, vinyl sulfone, sulfinic acid, active methylene, amino, amide, allyl, and the like. The polymer particle may also be a water dispersible condensation polymer such as a polyurethane, polyester, or polyamide. The polymer particles may contain surface functional groups such as sulfonic acid groups or their alkali metal salts. The polymer particles may be core-shell particles as described, for example, in U.S. Pat. No. 4,497,917.

The water-insoluble polymer particles are further characterized in that they have a dynamic shear modulus at the drying temperature for the coating that is greater than $5\times10^5$ dyne/cm$^2$ and less than $5\times10^8$ dyne/cm$^2$ when measured at a frequency of 10 Hz. Preferably, the shear modulus is greater than $1\times10^6$ dyne/cm$^2$ and less than $1\times10^8$ dyne/cm$^2$. When the polymer particle is a core-shell polymer, the shell comprises at least 20% and less than 80% of the total weight of the particle and the shear modulus requirements described above pertain to the shell polymer only, i.e., the shear modulus for the core polymer is not limited to the above requirements. The shear modulus is measured using the well known method of dynamic mechanical analysis (see for example, Ferry, J. D., "Viscoelastic Properties of Polymers", 3rd ed., Wiley, N.Y., 1980 or Boyer, R. F., "*Automated Dynamic Mechanical Testing*", in "Polymer Characterization", Craver, C. D., Ed., Advances in Chemistry Series, No. 203, American Chemical Society, Washington, D.C., 1983.). The value for the polymer particle shear modulus at the drying temperature relates to the extent of deformation and flow that the polymer particle may undergo during the film formation process. We have found that polymer particles that have a shear modulus less than $5\times10^5$ dyne/cm$^2$ require a higher volume % of conductive particles to achieve a conductive coating compared with coating compositions of the invention. While this phenomenon is not completely understood it may be that coating compositions of the invention provide enhanced chaining of the conductive particles into a conductive network. Polymer particles that have too low a shear modulus at the drying temperature may exhibit excessive deformation and flow during the film formation process which may have a deleterious effect on the chaining of the conductive particles. On the other hand, polymer particles that have too high a shear modulus undergo little or no deformation during the drying process and, therefore, form poor quality films which may undergo cracking which destroys the electrical continuity of the coating. Up to 15 weight % of the total polymer particle binder weight may comprise polymer particles that have a shear modulus value at the drying temperature which is either less than $5\times10^5$ dyne/cm$^2$ or greater than than $5\times10^8$ dyne/cm$^2$ without signficantly affecting the benefits of the present invention.

In the present invention, the electrically-conductive layer is formed by coating a composition comprising the electrically-conductive fine particles and the water-insoluble polymer particles dispersed in a liquid medium and drying the coating at an elevated drying temperature. The coating compositions of the invention may be applied to the support material by any coating method well known in the art, for example, hopper coating, gravure coating, roller coating, air knife coating, spray coating, etc. The coatings may be dried using a wide range of drying conditions. Preferably, the coatings are dried by impingement with air that has a temperature of at least 100° C. These high drying temperatures are desirable for high speed coating and drying and provide improved adhesion to the support materials employed in the photographic industry. The critical requirement is that at the drying temperature employed the polymer particle must have the shear modulus values described above.

The conductive layer preferably comprises 50 volume % or less of the conductive fine particles, more preferably 35 volume % or less of the conductive fine particles. The amount of the conductive particle contained in the coating is defined in terms of volume % rather than weight % since the densities of the conductive particles and polymer binders may differ widely. The binder for the conductive particles comprises the water-insoluble polymer particles with the specific characteristics described above. In some cases it may be desirable to utilize a coalescing aid to improve the film forming properties of the polymer particles. A coalescing aid is typically a high boiling point organic solvent that may be added to an aqueous coating composition containing a water-insoluble polymer particle binder to assist in the film formation process. The role of the coalescing aid is to reduce the shear modulus of the polymer particles in order to increase the deformation of the particles during the drying process. Since the presence of a coalescing aid affects the modulus of a polymer particle binder during the drying process, when a coalescing aid is included in the coating compositions of the invention, the range of acceptable polymer particle shear modulus values specified above must be determined for the polymer particle in the presence of the coalescing aid.

The coating compositions of the invention may also contain suitable crosslinking agents including aldehydes, epoxy comounds, polyfunctional aziridines, vinyl sulfones, methoxyalkyl melamines, triazines, polyisocyanates, dioxane derivatives such as dihydroxydioxane, carbodiimides, and the like. The crosslinking agents may react with functional groups present on the polymer particle binder in the coating composition.

Matte particles well known in the art may also be used in the coating compositions of the invention, such matting agents have been described in Research Disclosure No. 308, published December 1989, pages 1008 to 1009. When polymer matte particles are employed, the polymer may contain reactive functional groups capable of forming covalent bonds with the binder polymer by intermolecular crosslinking or by reaction with a crosslinking agent in order to promote improved adhesion of the matte particles to the coated layers. Suitable reactive functional groups include: hydroxyl, carboxyl, carbodiimide, epoxide, aziridine, vinyl sulfone, sulfinic acid, active methylene, amino, amide, allyl, and the like.

The coating compositions of the present invention may also include lubricants or combinations of lubricants to reduce sliding friction of the image elements in accordance with the invention. Typical lubricants include (1) silicone based materials disclosed, for example, in U.S. Pat. Nos. 3,489,567, 3,080,317, 3,042,522, 4,004,927, and 4,047,958, and in British Patent Nos. 955,061 and 1,143,118; (2) higher fatty acids and derivatives, higher alcohols and derivatives, metal salts of higher fatty acids, higher fatty acid esters, higher fatty acid amides, polyhydric alcohol esters of higher fatty acids, etc disclosed in U.S. Pat. Nos. 2,454,043, 2,732,305, 2,976,148, 3,206,311, 3,933,516, 2,588,765, 3,121,060, 3,502,473, 3,042,222, and 4,427,964, in British Patent Nos. 1,263,722, 1,198,387, 1,430,997, 1,466,304, 1,320,757, 1,320,565, and 1,320,756, and in German Patent Nos. 1,284,295 and 1,284,294; (3) liquid paraffin and paraffin or wax like materials such as carnauba wax, natural and synthetic waxes, petroleum waxes, mineral waxes and the like; (4) perfluoro- or fluoro- or fluorochloro-containing materials, which include poly(tetrafluoroethlyene), poly (trifluorochloroethylene), poly(vinylidene fluoride, poly (trifluorochloroethylene-co-vinyl chloride), poly(meth) acrylates or poly(meth)acrylamides containing perfluoroalkyl side groups, and the like. Lubricants useful in the present invention are described in further detail in Research Disclosure No.308, published December 1989, page 1006.

In addition to matte particles and lubricants, the layer can additionally contain wetting aids, biocides, dispersing aids, thickeners, antifoam agents, soluble or solid particle dyes, magnetic particles, and other addenda well known in the photographic art. The conductive layer is applied from an aqueous coating formulation to give dried coating weights preferably of about 100 to 1500 mg/m$^2$.

In a particularly preferred embodiment, the imaging elements of this invention are photographic elements, such as photographic films, photographic papers or photographic glass plates, in which the image-forming layer is a radiation-sensitive silver halide emulsion layer. Such emulsion layers typically comprise a film-forming hydrophilic colloid. The most commonly used of these is gelatin and gelatin is a particularly preferred material for use in this invention. Useful gelatins include alkali-treated gelatin (cattle bone or hide gelatin), acid-treated gelatin (pigskin gelatin) and gelatin derivatives such as acetylated gelatin, phthalated gelatin and the like. Other hydrophilic colloids that can be utilized alone or in combination with gelatin include dextran, gum arabic, zein, casein, pectin, collagen derivatives, collodion, agar-agar, arrowroot, albumin, and the like. Still other useful hydrophilic colloids are water-soluble polyvinyl compounds such as polyvinyl alcohol, polyacrylamide, poly (vinylpyrrolidone), and the like.

The photographic elements of the present invention can be simple black-and-white or monochrome elements comprising a support bearing a layer of light-sensitive silver halide emulsion or they can be multilayer and/or multicolor elements.

Color photographic elements of this invention typically contain dye image-forming units sensitive to each of the three primary regions of the spectrum. Each unit can be comprised of a single silver halide emulsion layer or of multiple emulsion layers sensitive to a given region of the spectrum. The layers of the element, including the layers of the image-forming units, can be arranged in various orders as is well known in the art.

A preferred photographic element according to this invention comprises a support bearing at least one blue-sensitive silver halide emulsion layer having associated therewith a yellow image dye-providing material, at least one green-sensitive silver halide emulsion layer having associated therewith a magenta image dye-providing material and at least one red-sensitive silver halide emulsion layer having associated therewith a cyan image dye-providing material.

In addition to emulsion layers, the elements of the present invention can contain auxiliary layers conventional in photographic elements, such as overcoat layers, spacer layers, filter layers, interlayers, antihalation layers, pH lowering layers (sometimes referred to as acid layers and neutralizing layers), timing layers, opaque reflecting layers, opaque light-absorbing layers and the like. The support can be any suitable support used with photographic elements. Typical supports include polymeric films, paper (including polymer-coated paper), glass and the like. Details regarding supports and other layers of the photographic elements of this invention are contained in *Research Disclosure,* Item 36544, September, 1994.

The light-sensitive silver halide emulsions employed in the photographic elements of this invention can include coarse, regular or fine grain silver halide crystals or mixtures thereof and can be comprised of such silver halides as silver chloride, silver bromide, silver bromoiodide, silver chlorobromide, silver chloroiodide, silver chorobromoiodide, and mixtures thereof. The emulsions can be, for example, tabular grain light-sensitive silver halide emulsions. The emulsions can be negative-working or direct positive emulsions. They can form latent images predominantly on the surface of the silver halide grains or in the interior of the silver halide grains. They can be chemically and spectrally sensitized in accordance with usual practices. The emulsions typically will be gelatin emulsions although other hydrophilic colloids can be used in accordance with usual practice. Details regarding the silver halide emulsions are contained in *Research Disclosure,* Item 36544, September, 1994, and the references listed therein.

The photographic silver halide emulsions utilized in this invention can contain other addenda conventional in the photographic art. Useful addenda are described, for example, in *Research Disclosure,* Item 36544, September, 1994. Useful addenda include spectral sensitizing dyes, desensitizers, antifoggants, masking couplers, DIR couplers, DIR compounds, antistain agents, image dye stabilizers, absorbing materials such as filter dyes and UV absorbers, light-scattering materials, coating aids, plasticizers and lubricants, and the like.

Depending upon the dye-image-providing material employed in the photographic element, it can be incorporated in the silver halide emulsion layer or in a separate layer associated with the emulsion layer. The dye-image-providing material can be any of a number known in the art, such as dye-forming couplers, bleachable dyes, dye developers and redox dye-releasers, and the particular one employed will depend on the nature of the element, and the type of image desired.

Dye-image-providing materials employed with conventional color materials designed for processing with separate solutions are preferably dye-forming couplers; i.e., compounds which couple with oxidized developing agent to form a dye. Preferred couplers which form cyan dye images are phenols and naphthols. Preferred couplers which form magenta dye images are pyrazolones and pyrazolotriazoles. Preferred couplers which form yellow dye images are benzoylacetanilides and pivalylacetanilides.

The invention is illustrated by the following examples of its practice. The polymer particles utilized in the examples were prepared by emulsion polymerization which is well known in the art. The shear modulus for the polymers was determined as a function of temperature using a Rheometrics Dynamic Mechanical Analyzer. The measurements were made using a frequency of 10 Hz.

EXAMPLE 1

Water-insoluble polymers identified herein by the designations P-1, P-2, P-3 and P-4 were used as the binder in this example. The composition and particle size are summarized in Table 1 below.

TABLE 1

| Particle | Polymer Compostion | Particle Size (nm) |
|---|---|---|
| P-1 | butyl acrylate/sodium acrylamido-2-methylpropane sufonate/2-acetoacetoxy ethyl methacrylate 88.9/7.6/3.5 | 65 |
| P-2 | methyl acrylate/sodium acrylamido-2-methylpropane sufonate/2-acetoacetoxy ethyl methacrylate 88.9/7.6/3.5 | 80 |
| P-3 | butyl methacrylate/sodium acrylamido-2-methyl-propane sulfonate 95/5 | 65 |
| P-4 | ethyl methacrylate/sodium acrylamido-2-methyl-propane sulfonate/2-acetoacetoxy ethyl methacrylate 88.9/7.6/3.5 | 78 |

Conductive coatings comprising conductive fine particles and polymer binder were coated onto 4 mil thick polyethylene terephthalate film support that had been subbed with a terpolymer latex of acrylonitrile, vinylidene chloride, and acrylic acid. The aqueous coating formulations comprising about 4 weight % total solids were dried at various temperatures to give dried coating weights of 1000 mg/m$^2$. The coating formulations contained; 2.4 weight % of conductive tin oxide particles (doped with 6% antimony) with an average primary particle size of about 15 nm, 1.6 weight % of the polymer particles, and 0.01 weight % of a nonionic surfactant. This gave dried coatings with a volume % of conductive particles of approximately 20%.

The surface resistivity of the coatings was measured at 20% relative humidity using a 2-point probe. The coating compositions and resistivities for the coatings are tabulated in Table 2. As can be seen from the results, coating compositions of the invention that contain a water-insoluble polymer particle binder that has a shear modulus at the drying temperature for the coating that is greater than $5\times10^5$ dyne/cm$^2$ and less than $5\times10^8$ dyne/cm$^2$ provide resistivity values that are nearly one order of magnitude superior to the comparative coating compositions.

Dry adhesion of the conductive layers to the support was determined by scribing small hatch marks in the coating with a razor blade, placing a piece of high tack tape over the scribed area and then quickly pulling the tape from the surface. The amount of the scribed area removed is a measure of the dry adhesion. Wet adhesion for the coatings was tested by placing the test samples in deionized water at 35° C. for 1 minute. While still wet, a one millimeter wide line was scribed in the coating and a finger was rubbed vigorously across the scribe line. The percent of the rubbed area that was removed was used as a measure of wet adhesion. The wet and dry adhesion for the coatings of the invention were found to be excellent.

TABLE 2

| | Coating No. | Binder | Drying Temperature (° C.) | Shear Modulus at the Drying Temperature (dyne/cm$^2$) | Surface Resistivity (Ω per square) |
|---|---|---|---|---|---|
| Comparative | 1 | P-1 | 25 | $2\times10^5$ | $4.0\times10^9$ |
| Comparative | 2 | P-1 | 50 | $1\times10^5$ | $4.0\times10^9$ |
| Comparative | 3 | P-1 | 80 | $9\times10^4$ | $5.0\times10^9$ |
| Comparative | 4 | P-1 | 100 | $9\times10^4$ | $4.0\times10^9$ |
| Invention | 5 | P-2 | 25 | $1\times10^8$ | $6.2\times10^8$ |
| Invention | 6 | P-2 | 50 | $4\times10^6$ | $3.2\times10^8$ |
| Invention | 7 | P-2 | 80 | $8\times10^5$ | $8.0\times10^8$ |
| Comparative | 8 | P-2 | 100 | $4\times10^5$ | $3.2\times10^9$ |
| Invention | 9 | P-3 | 50 | $4\times10^8$ | $1.6\times10^8$ |
| Invention | 10 | P-3 | 80 | $8\times10^6$ | $2.0\times10^8$ |
| Invention | 11 | P-3 | 100 | $2\times10^6$ | $2.0\times10^8$ |
| Comparative | 12 | P-3 | 150 | $2\times10^5$ | $2.0\times10^9$ |
| Comparative | 13 | P-3 | 200 | $<2\times10^5$ | $6.3\times10^9$ |
| Comparative | 14 | P-4 | 25 | $>2\times10^9$ | $5.0\times10^9$ |
| Comparative | 15 | P-4 | 50 | $>2\times10^9$ | $3.5\times10^9$ |
| Comparative | 16 | P-4 | 80 | $6\times10^8$ | $1.3\times10^9$ |
| Invention | 17 | P-4 | 100 | $2\times10^7$ | $4.0\times10^8$ |
| Invention | 18 | P-4 | 150 | $1\times10^6$ | $4.0\times10^8$ |
| Invention | 19 | P-4 | 200 | $1\times10^6$ | $5.0\times10^8$ |

EXAMPLE 2

Conductive coatings comprising conductive fine particles and polymer binders P-1 and P-4 were coated onto 4 mil thick polyethylene terephthalate film support in an analogous manner to that described in Example 1 above except the volume % of conductive tin oxide particles was varied from 8 to 60% and the drying temperature remained constant at 150° C. The surface resistivity of the coatings was measured at 20% relative humidity and the results are reported in Table 3. Coatings of the invention that comprise polymer particles P-4 as the binder that has a shear modulus at the drying temperature equal to $1\times10^6$ dyne/cm$^2$ provide surface resistivities that are about one order of magnitude superior than those containing polymer particle P-1 that has a shear modulus at the drying temperature less than $5\times10^5$ dyne/cm$^2$. From the results for coatings 26 and 27 it can be seen that at high volume % of conductive particles (i.e., greater than 50%) the benefit of enhanced chaining of the conductive particles due to the viscoelastic properties of the polymer particle binder is insignificant.

TABLE 3

| | Coating No. | Binder | Volume % $SnO_2$ | Surface Resistivity (Ω per square) |
|---|---|---|---|---|
| Comparative | 20 | P-1 | 8 | $3.2 \times 10^{11}$ |
| Invention | 21 | P-4 | 8 | $6.3 \times 10^{10}$ |
| Comparative | 22 | P-1 | 15 | $5.0 \times 10^{10}$ |
| Invention | 23 | P-4 | 15 | $2.5 \times 10^{9}$ |
| Comparative | 24 | P-1 | 29 | $3.2 \times 10^{9}$ |
| Invention | 25 | P-4 | 29 | $3.2 \times 10^{8}$ |
| Comparative | 26 | P-1 | 60 | $6.3 \times 10^{7}$ |
| Comparative | 27 | P-4 | 60 | $7.9 \times 10^{7}$ |

EXAMPLE 3

Conductive layers were prepared from coating compositions containing conductive tin oxide particles and the core-shell polymer particles described in Table 4. The coatings were applied onto the aforementioned polyester support and dried at 100° C. to give conductive layers with a dried coating weight of 1000 mg/m$^2$. The surface resistivity for the coatings was measured at 20% relative humidity and the results reported in Table 5. Comparing the resistivity value for coating 29 with that for coating 28 and coating 31 with that for coating 30 clearly shows that shell polymers with a shear modulus that is between $5\times10^5$ and $5\times10^8$ dyne/cm$^2$ provide superior performance compared with core/shell polymer particles in which the shell polymer has too low a shear modulus at the drying temperature.

TABLE 4

| Particle | Core Composition | Shell Composition | Core/ Shell Ratio | Particle Size (nm) |
|---|---|---|---|---|
| P-5 | methyl methacrylate/ ethylene glycol dimethacrylate/allyl methacrylate 90/5/5 | ethyl acetate | 70/30 | 50 |
| P-6 | ethyl acrylate/ ethylene glycol dimethacrylate/allyl methacrylate 85/10/5 | ethyl methacrylate | 65/35 | 15 |

TABLE 5

| | Coating No. | Binder | Shear Modulus at the Drying Temperature (dyne/cm$^2$) | Volume % $SnO_2$ | Surface Resistivity (Ω per square) |
|---|---|---|---|---|---|
| Comparative | 28 | P-5 | $<5 \times 10^5$ | 10 | $1.0 \times 10^{11}$ |
| Invention | 29 | P-6 | $1 \times 10^7$ | 10 | $1.2 \times 10^{10}$ |
| Comparative | 30 | P-5 | $<5 \times 10^5$ | 20 | $1.6 \times 10^{9}$ |
| Invention | 31 | P-6 | $1 \times 10^7$ | 20 | $3.2 \times 10^{8}$ |

EXAMPLE 4

Conductive layers were prepared from coating compositions containing 20 volume % conductive tin oxide particles and a mixture of particles P-1 and P-3. The coatings were applied onto the aforementioned polyester support and dried at 100° C. to give conductive layers with a dried coating weight of 1000 mg/m$^2$. At this temperature particle P-1 has a shear modulus value less than $5\times10^5$ dyne/cm$^2$. The surface resistivity for the coatings was measured at 20% relative humidity and the results reported in Table 6.

TABLE 6

| | Coating No. | Binder | Wt % Particle P-1 in Polymer Binder | Surface Resistivity (Ω per square) |
|---|---|---|---|---|
| Invention | 32 | P-3 | 0 | $3.1 \times 10^{8}$ |
| Invention | 33 | P-1/P-3 | 5 | $4.0 \times 10^{8}$ |
| Invention | 34 | P-1/P-3 | 10 | $5.0 \times 10^{8}$ |
| Invention | 35 | P-1/P-3 | 15 | $7.0 \times 10^{8}$ |
| Invention | 36 | P-1/P-3 | 20 | $1.0 \times 10^{9}$ |
| Comparative | 37 | P-1/P-3 | 30 | $4.4 \times 10^{9}$ |
| Comparative | 38 | P-1 | 100 | $5.0 \times 10^{9}$ |

The results show that up to 15 weight % of the polymer particle binder may include polymer particles that have shear modulus values at the drying temperature that are outside the range $5\times10^5$ dyne/cm$^2$ to $5\times10^8$ dyne/cm$^2$ without significantly affecting the benefits of the invention. U.S. Pat. No. 5,447,832 describes coating compositions comprising a mixture of film forming and non-film forming particles, including those containing conductive metal oxide particles. In the '832 patent, examples are described for coatings that comprise conductive tin oxide particles, a film forming polyurethane, and a non-film forming polymethyl methacrylate latex. However, at the drying condition employed in the examples (100° C.) the polyurethane particle has a shear modulus value less than $5\times10^5$ dyne/cm$^2$ and the polymethyl methacrylate latex has a shear modulus value greater than $5\times10^8$ dyne/cm$^2$. Thus neither polymer particle employed in the '832 patent examples falls within the range specified in the present invention and as a result, the examples in the '832 patent yield inferior resistivity values compared with coating compositions of the present invention.

The invention has been described in detail with particular reference to certain preferred embodiments thereof, but it will be understood that variations and modifications can be effected within the spirit and scope of the invention.

We claim:

1. An imaging element for use in an image-forming process; said imaging element comprising a support, an image-forming layer, and an electrically-conductive layer; said electrically-conductive layer having been formed by coating a composition consisting essentially of electrically-conductive fine particles and, as a binder, water-insoluble polymer particles, and drying the coating at a drying temperature, wherein at least 85% of the water-insoluble polymer particles have a surface layer having a shear modulus that is greater than $5\times10^5$ dyne/cm$^2$ and less than $5\times10^8$ dyne/cm$^2$ at the drying temperature.

2. An imaging element as claimed in claim 1, wherein said electrically-conductive fine particles are composed of a doped-metal oxide, a metal oxide containing oxygen deficiencies, a metal antimonate, or a conductive nitride, carbide or boride.

3. An imaging element as claimed in claim 1, wherein said electrically-conductive fine particles are antimony-doped tin oxide particles.

4. An imaging element as claimed in claim 1, wherein said electrically-conductive fine particles have an average particle size of less than about 0.3 mm and a powder resistivity of $10^5$ Ω·cm or less.

5. An imaging element as claimed in claim 1, wherein said water-insoluble polymer particles have an average diameter of from about 10 nm to about 1000 nm.

6. An imaging element as claimed in claim 1, wherein said water-insoluble polymer particles have an average diameter of from 20 nm to 500 nm.

7. An imaging element as claimed in claim 1, wherein said water-insoluble polymer particles have a shear modulus at said drying temperature that is greater than $1\times10^6$ dyne/cm$^2$ and less than $1\times10^8$ dyne/cm$^2$.

8. An imaging element as claimed in claim 1, wherein said water-insoluble polymer particles are selected from the group consisting of polymers of styrene, derivatives of styrene, alkyl acrylates, derivatives of alkyl acrylates, alkyl methacrylates, derivatives of alkyl methacrylates, itaconic acid, derivatives of itaconic acid, olefins, vinylidene chloride, acrylonitrile, acrylamide, derivatives of acrylamide, methacrylamide, derivatives of methacrylamide, vinyl esters, vinyl ethers and urethanes.

9. An imaging element as claimed in claim 1, wherein said water-insoluble polymer particles are core/shell particles.

10. An imaging element as claimed in claim 1, wherein said water-insoluble polymer particles are particles of an interpolymer of methyl acrylate, sodium acrylamido-2-propane sulfonate and 2-acetoacetoxy ethyl methacrylate.

11. An imaging element as claimed in claim 1, wherein said water-insoluble polymer particles are particles of a copolymer of butyl methacrylate and sodium acrylamido-2-propane sulfonate.

12. An imaging element as claimed in claim 1, wherein said water-insoluble polymer particles are particles of an interpolymer of ethyl methacrylate, sodium acrylamido-2-propane sulfonate and 2-acetoacetoxy ethyl methacrylate.

13. An imaging element as claimed in claim 1, wherein said water-insoluble polymer particles are core/shell particles in which the shell comprises at least 20% and less than 80% of the total weight of the particle.

14. An imaging element as claimed in claim 1, wherein said electrically-conductive layer comprises 50 volume % or less of said electrically-conductive fine particles.

15. An imaging element as claimed in claim 1, wherein said electrically-conductive layer comprises 35 volume % or less of said electrically-conductive fine particles.

16. An imaging element as claimed in claim 1, wherein the dry coating weight of said electrically-conductive layer is in the range of from about 100 to about 1500 mg/m$^2$.

17. An imaging element as claimed in claim 1, wherein said support is a polyethylene terephthalate film.

18. An imaging element as claimed in claim 1, wherein said drying temperature is at least 100° C.

19. A photographic film comprising:

(1) a support;

(2) an electrically-conductive layer which serves as an antistatic layer overlying said support; and (3) a silver halide emulsion layer overlying said electrically-conductive layer; said electrically-conductive layer having been formed by coating a composition consisting essentially of electrically-conductive fine particles, and, as a binder, water-insoluble polymer particles and drying the coating at a drying temperature, wherein at least 85% of the water-insoluble polymer particles have a surface layer having a shear modulus that is greater than $5\times10^5$ dyne/cm$^2$ and less than $5\times10^8$ dyne/cm$^2$ at said drying temperature.

20. A photographic film comprising a cellulose ester or polyester support, an image-forming layer comprising a silver halide emulsion, and an electrically-conductive layer which serves as an antistatic layer; said electrically-conductive layer having been formed by coating a composition consisting essentially of electrically-conductive fine particles having an average particle size of less than about 0.3 mm and a powder resistivity of $10^5$ Ω·cm or less and, as a binder, water-insoluble polymer particles having an average diameter of from 20 nm to 500 nm, and drying the coating at a drying temperature, wherein at least 85% of the water-insoluble polymer particles have a surface layer having a shear modulus that is greater than $1\times10^6$ dyne/cm$^2$ and less than $1\times10^8$ dyne/cm$^2$ at said drying temperature wherein said electrically-conductive layer comprises 50 volume % or less of said electrically-conductive fine particles.

* * * * *